US012473066B2

(12) United States Patent
Saruwatari et al.

(10) Patent No.: US 12,473,066 B2
(45) Date of Patent: Nov. 18, 2025

(54) OUTBOARD MOTOR

(71) Applicant: YAMAHA HATSUDOKI KABUSHIKI KAISHA, Iwata (JP)

(72) Inventors: Kimitaka Saruwatari, Shizuoka (JP); Tomohiro Hagi, Shizuoka (JP); Yu Wakamizu, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 459 days.

(21) Appl. No.: 18/134,596

(22) Filed: Apr. 14, 2023

(65) Prior Publication Data

US 2024/0101238 A1 Mar. 28, 2024

(30) Foreign Application Priority Data

Sep. 22, 2022 (JP) ..... 2022-151615

(51) Int. Cl.
*B63H 20/12* (2006.01)
*B63H 20/32* (2006.01)
*B63H 23/34* (2006.01)

(52) U.S. Cl.
CPC ..... *B63H 20/12* (2013.01); *B63H 20/32* (2013.01); *B63H 23/34* (2013.01)

(58) Field of Classification Search
CPC ..... B63H 20/12; B63H 20/32; B63H 23/34
See application file for complete search history.

(56) References Cited

U.S. PATENT DOCUMENTS 6,814,635 B1 * 11/2004 Okabe ..... B63H 20/32 440/88 P
8,246,398 B2 * 8/2012 Inaba ..... B63H 20/12 440/58
10,800,502 B1 * 10/2020 Alby ..... B63H 20/28
11,780,548 B2 * 10/2023 Galletta, Jr. ..... B63H 20/32 718/1
2003/0224671 A1 * 12/2003 Katayama ..... B63H 20/001 192/85.42
2016/0375974 A1 * 12/2016 Loftus, Jr. ..... B63H 20/20 440/75
2023/0066941 A1 * 3/2023 Saruwatari ..... B63H 20/24

FOREIGN PATENT DOCUMENTS

EP 2497711 A1 * 9/2012 ..... B63H 20/20

* cited by examiner

*Primary Examiner* — S. Joseph Morano
*Assistant Examiner* — Jovon E Hayes
(74) *Attorney, Agent, or Firm* — Keating & Bennett, LLP

(57) ABSTRACT

An outboard motor includes a first housing, a second housing, and a steering mechanism. The steering mechanism is operable to steer the second housing around a steering axis. The steering mechanism includes a pinion gear, a first rack, and a second rack. The pinion gear is connected to the first housing or the second housing. The first rack includes first teeth and a first relief portion. The first teeth mesh with the pinion gear and are arranged side by side with each other in a first direction. The first relief portion does not mesh with the pinion gear and allows the pinion gear to idle. The first rack is movable in the first direction. The second rack includes second teeth. The second teeth mesh with the pinion gear and are arranged side by side with each other in a second direction. The second rack is movable in the second direction.

12 Claims, 16 Drawing Sheets

OUTBOARD MOTOR

CROSS REFERENCE TO RELATED APPLICATIONS

This application claims the benefit of priority to Japanese Patent Application No. 2022-151615 filed on Sep. 22, 2022. The entire contents of this application are hereby incorporated herein by reference.

BACKGROUND OF THE INVENTION

1. Field of the Invention

The present invention relates to an outboard motor.

2. Description of the Related Art

Some outboard motors are equipped with a steering mechanism that turns a housing around a steering axis. For example, the outboard motor of U.S. Pat. No. 10,800,502 includes a lower gear case and a steering mechanism for steering the lower gear case. The steering mechanism steers the lower gear case with a rack and pinion. Specifically, the steering mechanism includes a piston, a steering column, and a steering actuator. The piston includes a plurality of teeth. The steering column is connected to the lower gear case and includes a plurality of teeth. The plurality of teeth of the steering column mesh with the plurality of teeth of the piston. The steering actuator linearly moves the piston. As a result, the steering column rotates to steer the lower gear case.

SUMMARY OF THE INVENTION

In the rack-and-pinion steering mechanism as described above, the steering angle of the housing increases according to the movement distance of the rack. Therefore, in order to obtain a large steering angle, the movement distance of the rack becomes large, and the size of the outboard motor becomes large. Preferred embodiments of the present invention provide outboard motors that are each able to obtain a large steering angle while reducing or preventing an increase in sizes of the outboard motors.

An outboard motor according to a preferred embodiment of the present invention includes a first housing, a second housing, a propeller shaft, and a steering mechanism. The second housing is supported by the first housing and is steerable around a steering axis. The propeller shaft is in the second housing and extends in a front-rear direction of the outboard motor. The steering mechanism is operable to steer the second housing around the steering axis. The steering mechanism includes a pinion gear, a first rack, and a second rack. The pinion gear is connected to the first housing or the second housing. The first rack includes a plurality of first teeth and a first relief portion. The plurality of first teeth mesh with the pinion gear and are arranged side by side with each other in a first direction. The first relief portion allows the pinion gear to idle by not meshing with the pinion gear. The first rack is movable in the first direction. The second rack includes a plurality of second teeth. The plurality of second teeth mesh with the pinion gear and are arranged side by side with each other in a second direction. The second rack is movable in the second direction.

According to the above-described preferred embodiment, the pinion gear rotates and the second housing is steered by moving the first rack in the first direction while the first teeth mesh with the pinion gear. Further, the second rack moves in the second direction while the second teeth meshes with the pinion gear, thus rotating the pinion gear and steering the second housing. At that time, the first relief portion of the first rack causes the pinion gear to idle with respect to the first rack. Therefore, the pinion gear rotates and the second housing is steered without moving the first rack. As a result, a large steering angle is obtained while reducing or preventing an increase in the size of the outboard motor.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
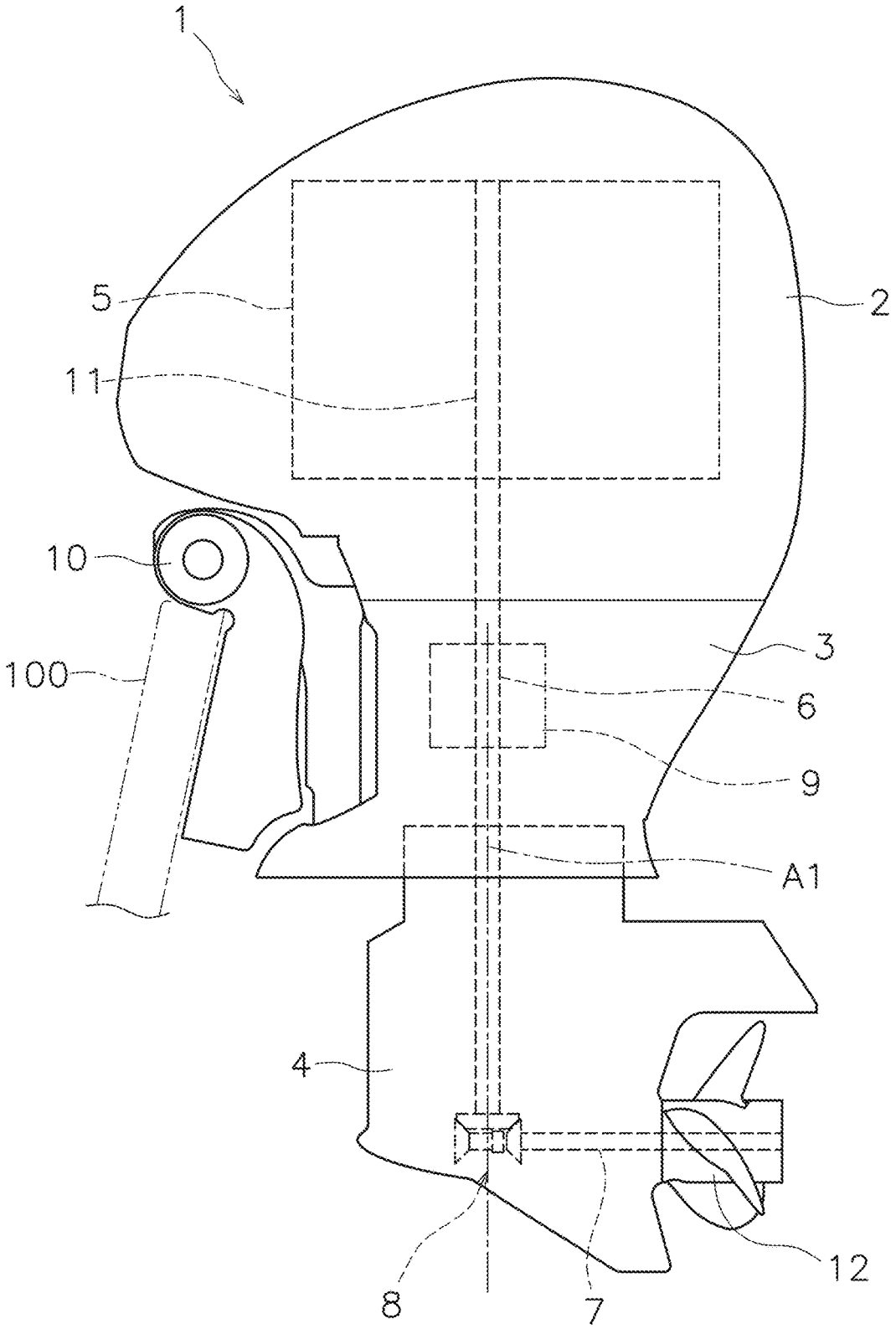
FIG. 1 is a side view of an outboard motor according to a preferred embodiment of the present invention.

Preferred embodiments of the present invention will be described below with reference to the drawings. FIG. 1 is a side view of an outboard motor 1 according to a preferred embodiment of the present invention. The outboard motor 1 is attached to a stern of a boat 100 via a bracket 10. The outboard motor 1 generates thrust to propel the boat 100. The outboard motor 1 includes a cowl 2, a first housing 3, a second housing 4, a drive source 5, a drive shaft 6, a propeller shaft 7, a shift mechanism 8, and a steering mechanism 9.

The drive source 5 generates thrust that propels the boat 100. The drive source 5 is, for example, an internal combustion engine. Alternatively, the drive source 5 may include an electric motor. The drive source 5 is arranged in the cowl 2. The first housing 3 is arranged below the cowl 2. The second housing 4 is arranged below the first housing 3. The second housing 4 is supported by the first housing 3 so as to be steerable about the steering axis A1.

The drive source 5 includes a crankshaft 11. The crankshaft 11 extends in the vertical direction of the outboard motor 1. The drive shaft 6 is connected to the crankshaft 11. The drive shaft 6 extends in the vertical direction of the outboard motor 1. The drive shaft 6 is arranged in the first housing 3 and the second housing 4. The propeller shaft 7 extends in the front-rear direction of the outboard motor 1. The propeller shaft 7 is arranged in the second housing 4. The propeller shaft 7 is connected to the drive shaft 6 via the shift mechanism 8. A propeller 12 is attached to the propeller shaft 7. The shift mechanism 8 switches the transmission direction of rotation from the drive shaft 6 to the propeller shaft 7 between the forward direction and the reverse direction. The shift mechanism 8 includes gears and clutches, for example.

Figure 2:
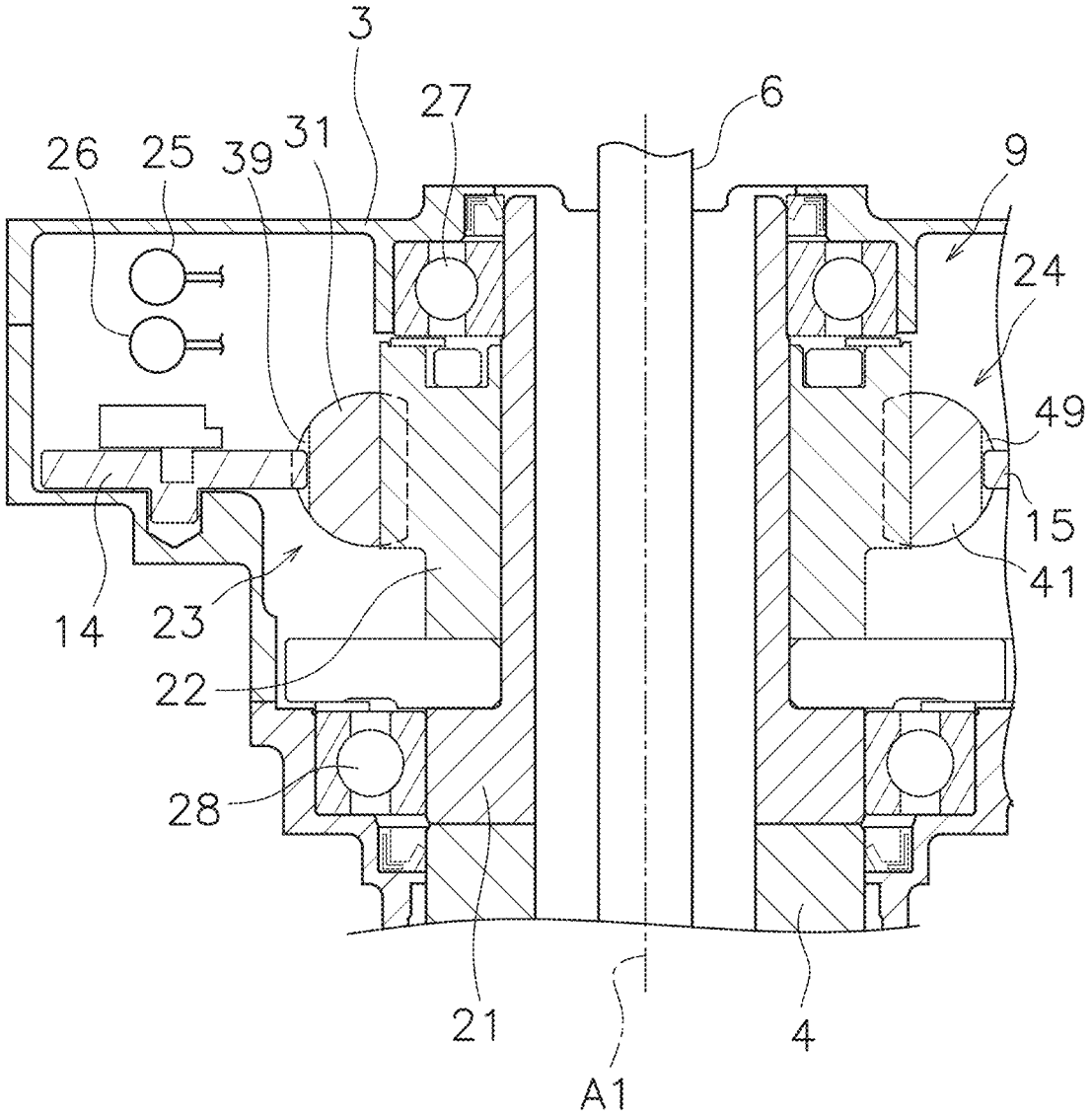
FIG. 2 is a cross-sectional view of a portion of the outboard motor.
Figure 3:
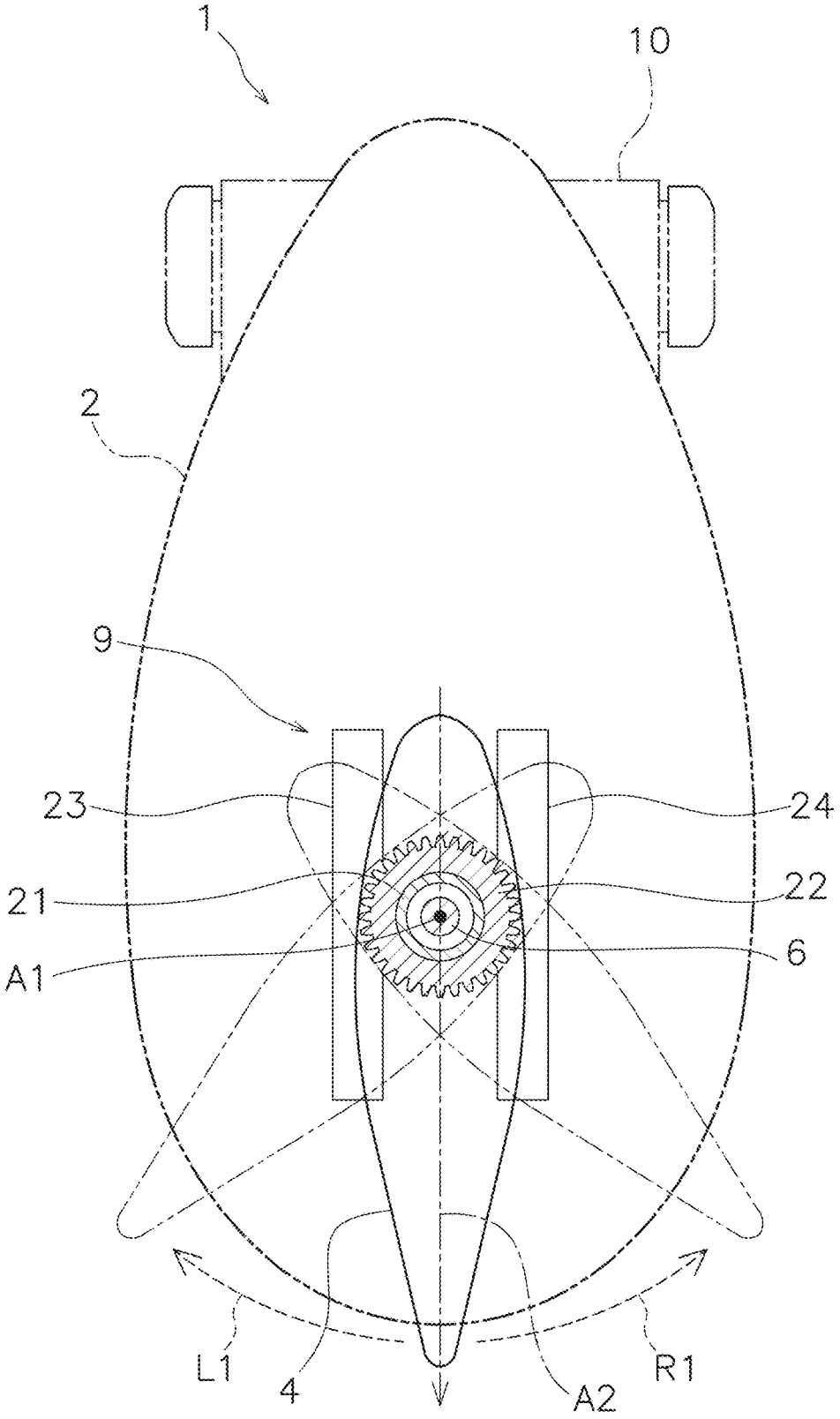
FIG. 3 is a top view of the outboard motor.
Figure 4:
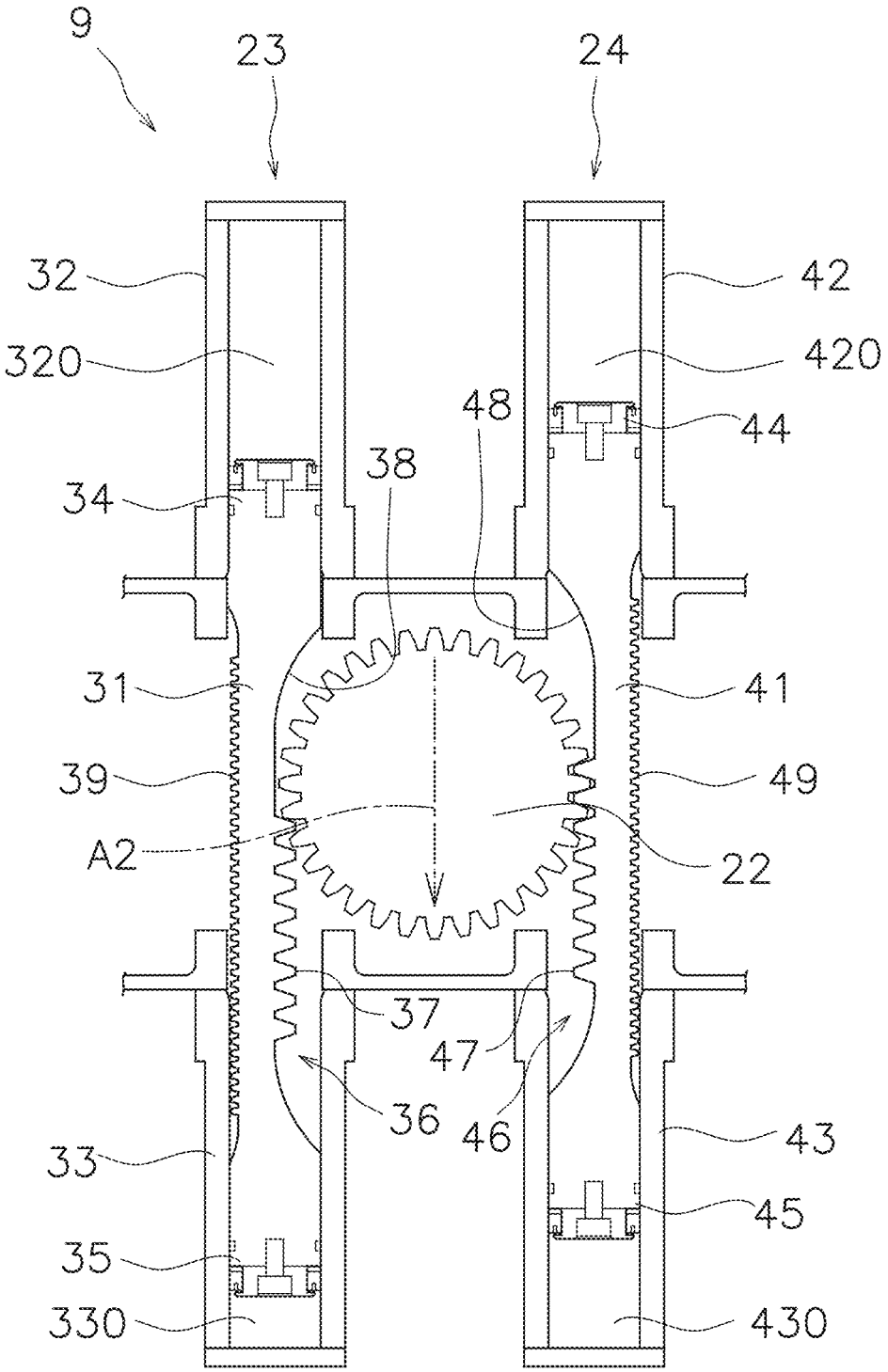
FIG. 4 is a top view showing an operation of a steering mechanism.
Figure 5:
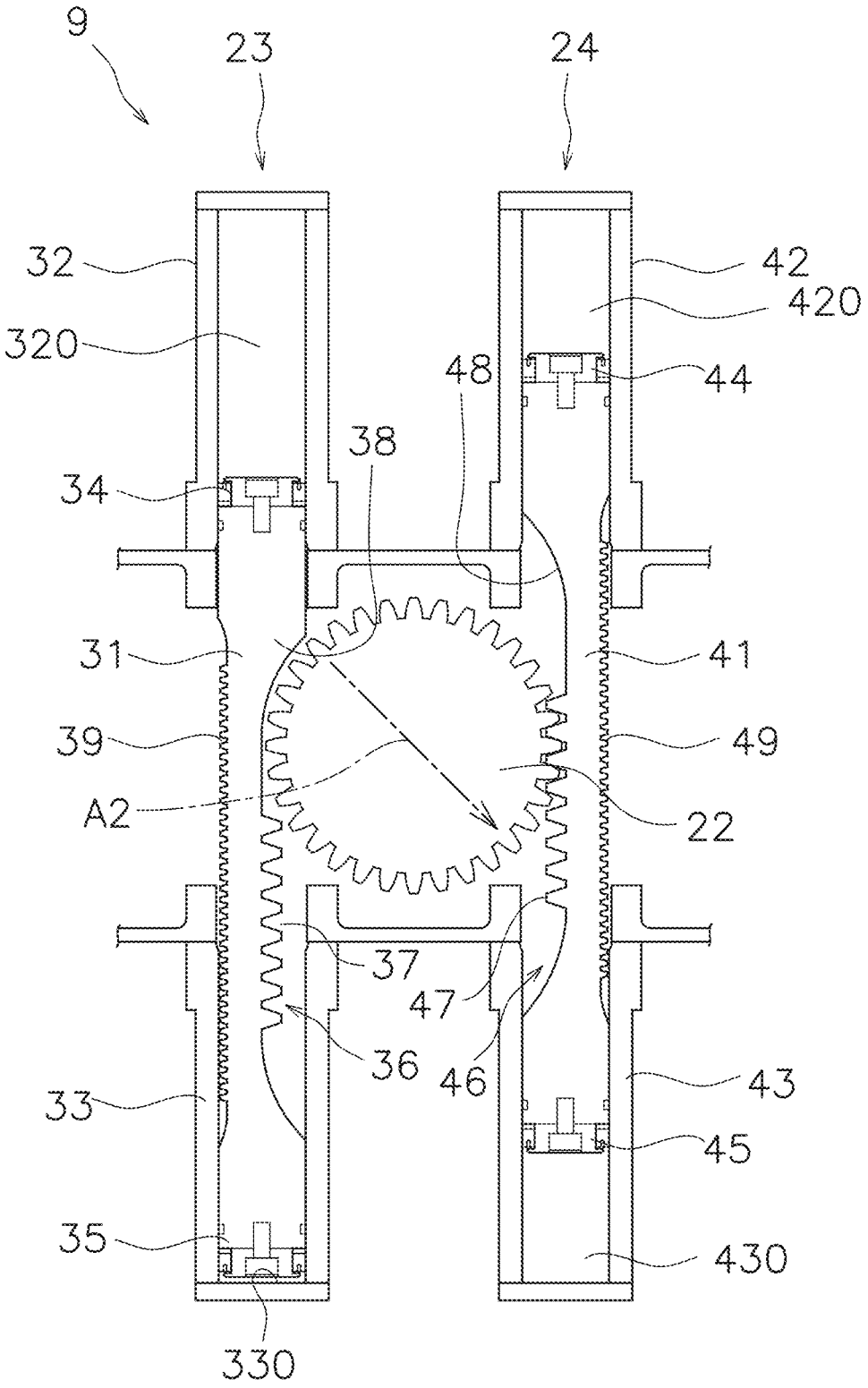
FIG. 5 is a top view showing the operation of the steering mechanism.
Figure 6:
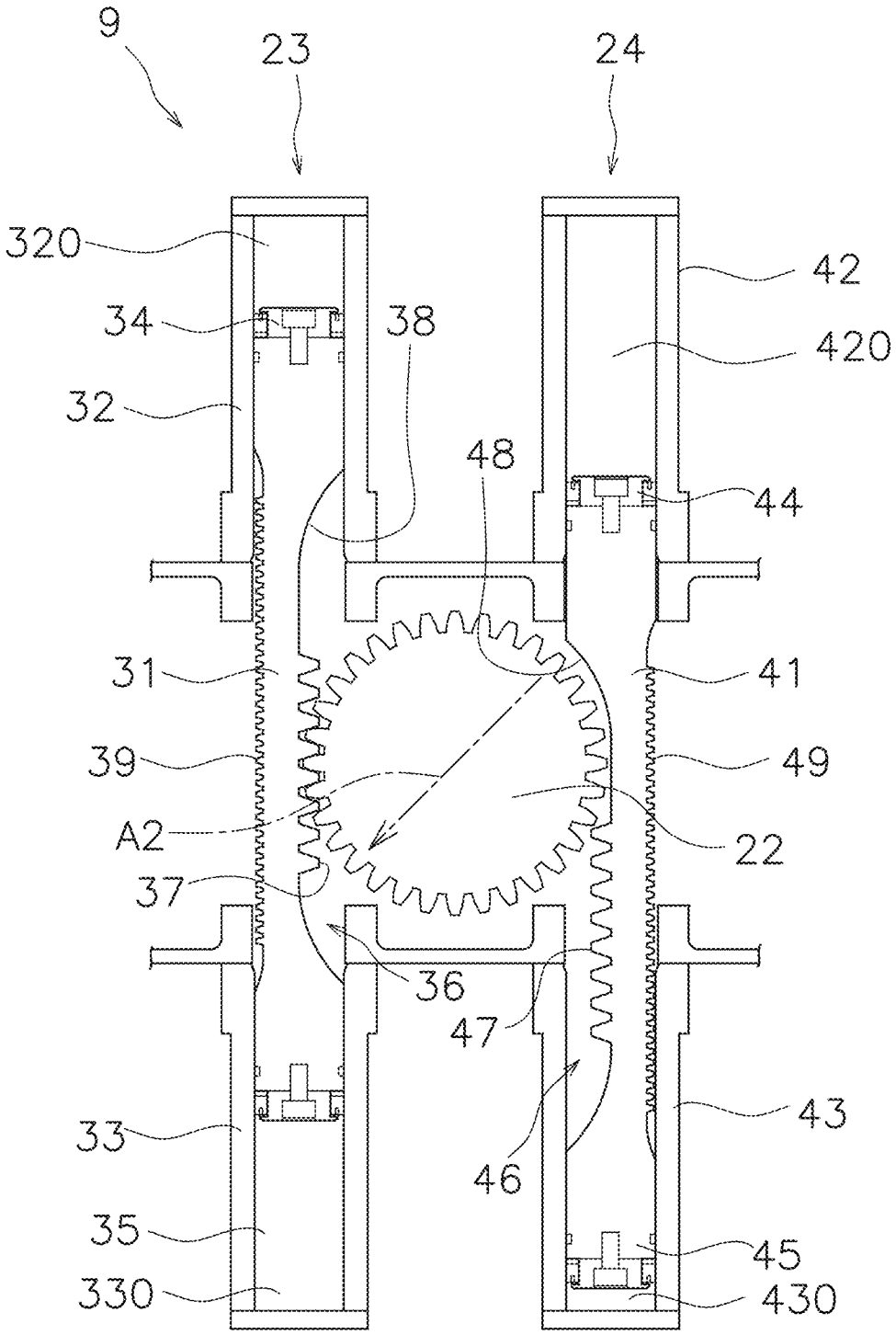
FIG. 6 is a top view showing the operation of the steering mechanism.

FIG. 2 is a side sectional view showing a portion of the outboard motor 1. FIG. 3 is a top view of the outboard motor 1. FIGS. 4 to 6 are schematic top views showing the operation of the steering mechanism 9. As shown in FIG. 3, the steering mechanism 9 rotates the second housing 4 about the steering axis A1 with respect to the first housing 3 in accordance with the operation of a steering operation member such as a steering wheel or a joystick. The steering axis A1 extends in the vertical direction of the outboard motor 1. The steering axis A1 is concentric with the drive shaft 6.

As shown in FIG. 2, the steering mechanism 9 includes a steering shaft 21, a pinion gear 22, a first cylinder 23, a second cylinder 24, a first hydraulic actuator 25, and a second hydraulic actuator 26. The steering shaft 21 is arranged in the first housing 3. The steering shaft 21 extends in the vertical direction of the outboard motor 1. The steering shaft 21 is concentric with the drive shaft 6. The steering shaft 21 has a hollow tubular shape. The drive shaft 6 extends through the steering shaft 21. The steering shaft 21 is rotatable with respect to the drive shaft 6. The steering shaft 21 is rotatably supported with respect to the first housing 3 via bearings 27 and 28. The steering shaft 21 is fixed to the second housing 4.

The pinion gear 22 is fixed to the steering shaft 21. The pinion gear 22 is connected to the steering shaft 21 and non-rotatable with respect to the steering shaft 21. The steering shaft 21 rotates together with the pinion gear 22. The pinion gear 22 is connected to the second housing 4 via the steering shaft 21. Therefore, the second housing 4 rotates around the steering axis A1 in accordance with the rotation of the pinion gear 22.

The first cylinder 23 and the second cylinder 24 are hydraulic cylinders. The first cylinder 23 and the second cylinder 24 rotate the pinion gear 22. The first cylinder 23 and the second cylinder 24 extend in the front-rear direction of the outboard motor 1. The first cylinder 23 and the second cylinder 24 are spaced apart from each other in the left-right direction of the outboard motor 1. The pinion gear 22 is arranged between the first cylinder 23 and the second cylinder 24.

The first hydraulic actuator 25 is a hydraulic pump. The first hydraulic actuator 25 supplies hydraulic fluid to the first cylinder 23 by being driven by an electric motor. The electric motor may be driven by electricity generated by the drive source 5. Alternatively, the first hydraulic actuator 25 may be driven by the drive source 5. The first cylinder 23 rotates the pinion gear 22 by being driven by hydraulic fluid from the first hydraulic actuator 25.

The second hydraulic actuator 26 is a hydraulic pump. The second hydraulic actuator 26 supplies hydraulic fluid to the second cylinder 24 by being driven by an electric motor. The electric motor may be driven by electricity generated by the drive source 5. Alternatively, the second hydraulic actuator 26 may be driven by the drive source 5. The second cylinder 24 rotates the pinion gear 22 by being driven by hydraulic fluid from the second hydraulic actuator 26.

As shown in FIG. 4, the first cylinder 23 includes a first rack 31, a first cylinder tube 32, and a second cylinder tube 33. The first rack 31 extends in the front-rear direction. The first rack 31 is movable in the front-rear direction. The first rack 31 includes a first end 34 and a second end 35. The first end 34 is arranged in the first cylinder tube 32. The second end 35 is arranged in the second cylinder tube 33. The first cylinder tube 32 and the second cylinder tube 33 are spaced apart from each other in the front-rear direction. The pinion gear 22 is arranged between the first cylinder tube 32 and the second cylinder tube 33 in the front-rear direction.

The first rack 31 linearly moves in the front-rear direction due to hydraulic pressure from the first hydraulic actuator 25. Specifically, the first cylinder tube 32 includes a first chamber 320. The second cylinder tube 33 includes a second chamber 330. By supplying hydraulic fluid from the first hydraulic actuator 25 to the first chamber 320, the first rack 31 moves rearward due to the hydraulic pressure in the first chamber 320. By supplying hydraulic fluid from the first hydraulic actuator 25 to the second chamber 330, the first rack 31 moves forward due to the hydraulic pressure in the second chamber 330.

The first rack 31 includes a first recess 36, a plurality of first teeth 37, and a first relief portion 38. The first recess 36 is provided on the inner side surface of the first rack 31. The first recess 36 extends in the front-rear direction. The first recess 36 is located between the first end 34 and the second end 35. The first recess 36 faces the pinion gear 22. The plurality of first teeth 37 are provided in the first recess 36. The plurality of first teeth 37 are arranged side by side with each other in the front-rear direction. The pinion gear 22 is rotated by moving the first rack 31 forward and backward while the plurality of first teeth 37 are in mesh with the pinion gear 22.

The first relief portion 38 is a portion of the first recess 36 where the first teeth 37 are not provided. The first relief portion 38 is arranged in front of the plurality of first teeth 37. The first relief portion 38 has a shape that avoids the pinion gear 22 so as not to contact the pinion gear 22. In a state where the pinion gear 22 is arranged in the first relief portion 38, the first relief portion 38 does not contact the pinion gear 22. The plurality of first teeth 37 do not mesh with the pinion gear 22 in a state where the pinion gear 22 is arranged in the first relief portion 38. Therefore, in a case where the pinion gear 22 is arranged in the first relief portion 38, the pinion gear 22 is able to idle with respect to the first rack 31 without moving the first rack 31. The second cylinder 24 has a structure substantially bilaterally symmetrical with the first cylinder 23. The second cylinder 24 includes a second rack 41, a third cylinder tube 42, and a fourth cylinder tube 43. The second rack 41 extends in the front-rear direction. The second rack 41 is movable in the front-rear direction. The second rack 41 includes a third end 44 and a fourth end 45. The third end 44 is arranged in the third cylinder tube 42. The fourth end 45 is arranged in the fourth cylinder tube 43. The third cylinder tube 42 and the fourth cylinder tube 43 are spaced apart from each other in the front-rear direction. The pinion gear 22 is arranged between the third cylinder tube 42 and the fourth cylinder tube 43 in the front-rear direction.

The second rack 41 linearly moves in the front-rear direction due to hydraulic pressure from the second hydraulic actuator 26. Specifically, the third cylinder tube 42 includes a third chamber 420. The fourth cylinder tube 43 includes a fourth chamber 430. By supplying hydraulic fluid from the second hydraulic actuator 26 to the third chamber 420, the second rack 41 moves rearward due to the hydraulic pressure in the third chamber 420. By supplying hydraulic fluid from the second hydraulic actuator 26 to the fourth chamber 430, the second rack 41 moves forward due to the hydraulic pressure in the fourth chamber 430.

The second rack 41 includes a second recess 46, a plurality of second teeth 47, and a second relief portion 48. The second recess 46 is provided on the inner side surface of the second rack 41. The second recess 46 extends in the front-rear direction. The second recess 46 is located between the third end 44 and the fourth end 45. The second recess 46 faces the pinion gear 22. The plurality of second teeth 47 are provided in the second recess 46. The plurality of second teeth 47 are arranged side by side with each other in the front-rear direction. The pinion gear 22 is rotated by moving the second rack 41 forward and backward while the plurality of second teeth 47 are in mesh with the pinion gear 22.

The second relief portion 48 is a portion of the second recess 46 where the second teeth 47 are not provided. The second relief portion 48 is arranged in front of the plurality of second teeth 47. The second relief portion 48 has a shape that avoids the pinion gear 22 so as not to contact the pinion gear 22. In a state where the pinion gear 22 is arranged in the second relief portion 48, the second relief portion 48 does not contact the pinion gear 22. The plurality of second teeth 47 do not mesh with the pinion gear 22 in a state where the pinion gear 22 is arranged in the second relief portion 48. Therefore, in a case where the pinion gear 22 is arranged in the second relief portion 48, the pinion gear 22 is able to idle with respect to the second rack 41 without moving the second rack 41.

The first rack 31 includes a first detector 39. The first detector 39 is provided on the outer side surface of the first rack 31. The first detector 39 includes a plurality of teeth. The second rack 41 includes a second detector 49. The second detector 49 is provided on the outer side surface of the second rack 41. The second detector 49 includes a plurality of teeth.

As shown in FIG. 2, outboard motor 1 includes a first rack sensor 14 and a second rack sensor 15. The first rack sensor 14 meshes with the plurality of teeth of the first detector 39 of the first rack 31. The first rack sensor 14 detects the position of the first rack 31. The second rack sensor 15 meshes with the plurality of teeth of the second detector 49 of the second rack 41. The second rack sensor 15 detects the position of the second rack 41.

FIG. 4 shows the steering mechanism 9 in a neutral state. When the steering mechanism 9 is in the neutral state, the steering angle of the second housing 4 is 0 degrees. That is, in the neutral state, the second housing 4 and the propeller shaft 7 are arranged parallel to the front-rear direction of the outboard motor 1. As shown in FIGS. 3 to 6, the dashed line A2 indicates the direction of the second housing 4, that is, the direction of the propeller shaft 7. When the steering mechanism 9 is in the neutral state, the pinion gear 22 meshes with at least one of the first teeth 37 and the second teeth 47.

FIG. 5 shows the steering mechanism 9 in a right steering state. As the second rack 41 moves forward from the neutral state shown in FIG. 4, the steering mechanism 9 enters the right steering state shown in FIG. 5. When the steering mechanism 9 is in the right steering state, the second teeth 47 mesh with the pinion gear 22 and the first relief portion 38 faces the pinion gear 22. In the right steering state, the second rack 41 moves forward while the plurality of second teeth 47 mesh with the pinion gear 22, and the pinion gear 22 faces the first relief portion 38 and idles with respect to the first rack 31. Therefore, the first rack 31 does not move, and the pinion gear 22 rotates according to the movement of the second rack 41. As a result, the second housing 4 is steered rightward as indicated by the dashed arrow R1 in FIG. 3.

FIG. 6 shows the steering mechanism 9 in a left steering state. As the first rack 31 moves forward from the neutral state shown in FIG. 4, the steering mechanism 9 enters the left steering state shown in FIG. 6. When the steering mechanism 9 is in the left steering state, the first teeth 37 mesh with the pinion gear 22 and the second relief portion 48 faces the pinion gear 22. In the left steering state, the first rack 31 moves forward while the plurality of first teeth 37 mesh with the pinion gear 22, and the pinion gear 22 faces the second relief portion 48 and idles with respect to the second rack 41. Therefore, the second rack 41 does not move, and the pinion gear 22 rotates according to the movement of the first rack 31. As a result, the second housing 4 is steered leftward as indicated by the dashed arrow L1 in FIG. 3.

In the outboard motor 1 described above, when the second housing 4 is steered to the right, the pinion gear 22 idles with respect to the first rack 31 in the first relief portion 38. Therefore, the second housing 4 is steered by rotating the pinion gear 22 according to the movement of the second rack 41 without moving the first rack 31. Therefore, even if the length of the first rack 31 is short, a large steering angle is obtained.

Further, when the second housing 4 is steered leftward, the pinion gear 22 idles with respect to the second rack 41 in the second relief portion 48. Therefore, the second housing 4 is steered by rotating the pinion gear 22 according to the movement of the first rack 31 without moving the second rack 41. Therefore, even if the length of the second rack 41 is short, a large steering angle is obtained. As described above, a large steering angle is obtained while reducing or preventing an increase in the size of the outboard motor 1.

The position of the first rack 31 is held by hydraulic pressure in the first chamber 320 and the second chamber 330. The position of the second rack 41 is held by hydraulic pressure in the third chamber 420 and the fourth chamber 430. Therefore, the steering angle is stably maintained. For example, when the boat 100 is sailing, unintended changes in the steering angle due to factors such as water load are reduced or prevented.

Although preferred embodiments of the present invention have been described above, the present invention is not limited to the above-described preferred embodiments, and various modifications are possible without departing from the gist of the present invention.

The structures of the first cylinder 23 and the second cylinder 24 are not limited to those of the above-described preferred embodiments, and may be modified. For example, the second relief portion 48 may be omitted. The pinion gear 22 may be connected to the first housing 3 instead of the second housing 4. In that case, the first cylinder 23 and the second cylinder 24 may be supported by the second housing 4. The first rack 31 and the second rack 41 may be driven by hydraulic motors. Alternatively, the first rack 31 and the second rack 41 may be driven by an electric actuator such as an electric motor.

The direction of movement of the first rack 31 and the second rack 41 to rotate the pinion gear 22 is not limited to forward, and may be rearward. The first rack 31 and/or the second rack 41 may extend not only in the front-rear direction of the outboard motor 1 but also in other directions. That is, the first direction, which is the moving direction of the first rack 31, is not limited to the front-rear direction of the outboard motor 1, and may be other directions such as the left-right direction. The second direction, which is the moving direction of the second rack 41, is not limited to the front-rear direction of the outboard motor 1, and may be other directions such as the left-right direction.

Figure 7:
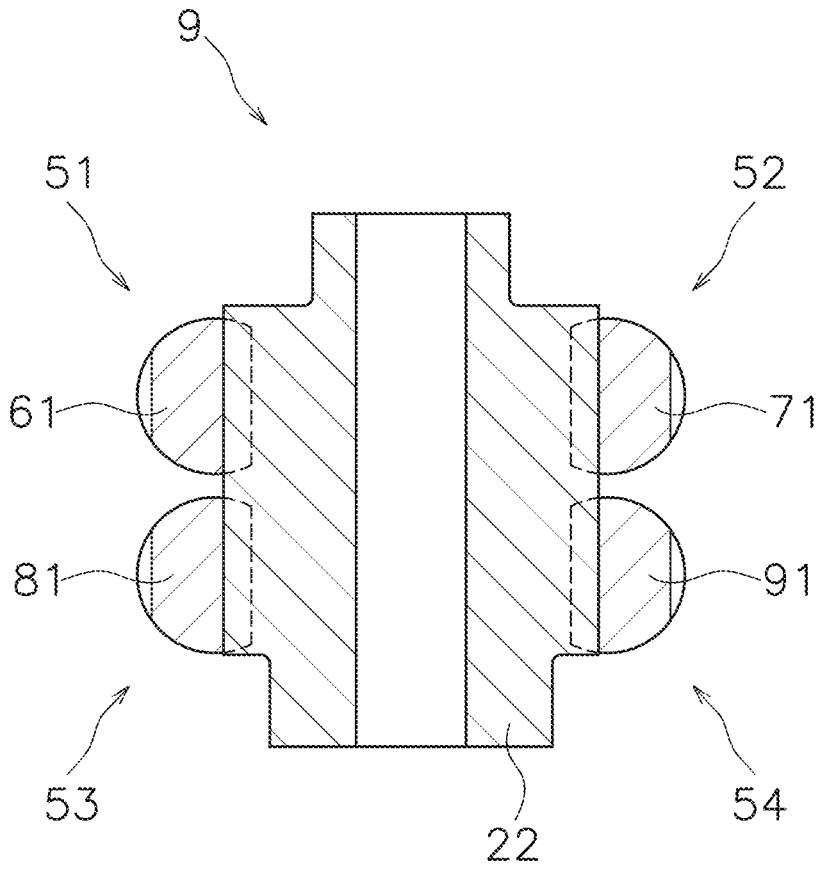
FIG. 7 is a cross-sectional view of a portion of the steering mechanism according to a modification of a preferred embodiment of the present invention.

In the above preferred embodiments, the number of racks rotating the pinion gear 22 is two. However, the number of racks may be greater than two. For example, FIG. 7 is a cross-sectional view showing a portion of the steering mechanism 9 according to a modification. As shown in FIG. 7, the steering mechanism 9 according to the modification includes first to fourth cylinders 51 to 54.

The first cylinder 51 includes a first rack 61. The second cylinder 52 includes a second rack 71. The first rack 61 and the second rack 71 are arranged in the same manner as the first rack 31 and the second rack 41 of the preferred embodiments described above. The third cylinder 53 includes a third rack 81. The third rack 81 is arranged vertically side by side with the first rack 61. The fourth cylinder 54 includes a fourth rack 91. The fourth rack 91 is arranged vertically side by side with the second rack 71.

FIGS. 8 to 16 are schematic top views showing the operation of the steering mechanism 9 according to the modification. The third cylinder 53 and the fourth cylinder 54 are arranged vertically side by side with the first cylinder 23 and the second cylinder 24, but for ease of understanding, in FIGS. 8 to 16, the third cylinder 53 and the fourth cylinder 54 are shown to the side of the first cylinder 23 and the second cylinder 24.

As shown in FIGS. 8 to 16, the first rack 61 includes a plurality of first teeth 62, a first relief portion 63, and a third relief portion 64. The plurality of first teeth 62 and the first relief portion 63 have the same configurations as the plurality of first teeth 37 and the first relief portion 38 of the preferred embodiments described above, respectively. The third relief portion 64 is arranged on the opposite side of the first relief portion 63 in the front-rear direction. The third relief portion 64 is arranged behind the plurality of first teeth 62. Other configurations of the first cylinder 51 are the same as those of the first cylinder 23 of the above-described preferred embodiments.

The second rack 71 includes a plurality of second teeth 72, a second relief portion 73, and a fourth relief portion 74. The plurality of second teeth 72 and the second relief portion 73 have the same configurations as the plurality of second teeth 47 and the second relief portion 48 of the preferred embodiments described above, respectively. The fourth relief portion 74 is arranged on the opposite side of the second relief portion 73 in the front-rear direction. The fourth relief portion 74 is arranged behind the plurality of second teeth 72. Other configurations of the second cylinder 52 are the same as those of the second cylinder 24 of the above-described preferred embodiments.

The third rack 81 includes a plurality of third teeth 82, a fifth relief portion 83, and a sixth relief portion 84. The plurality of third teeth 82, the fifth relief portion 83, and the sixth relief portion 84 have the same configurations as the plurality of first teeth 62, the first relief portion 63, and the third relief portion 64, respectively. Other configurations of the third cylinder 53 are the same as those of the first cylinder 51.

The fourth rack 91 includes a plurality of fourth teeth 92, a seventh relief portion 93, and an eighth relief portion 94. The plurality of fourth teeth 92, the seventh relief portion 93, and the eighth relief portion 94 have the same configurations as the plurality of second teeth 72, the second relief portion 73, and the fourth relief portion 74, respectively. Other configurations of the fourth cylinder 54 are the same as those of the second cylinder 52.

Figure 8:
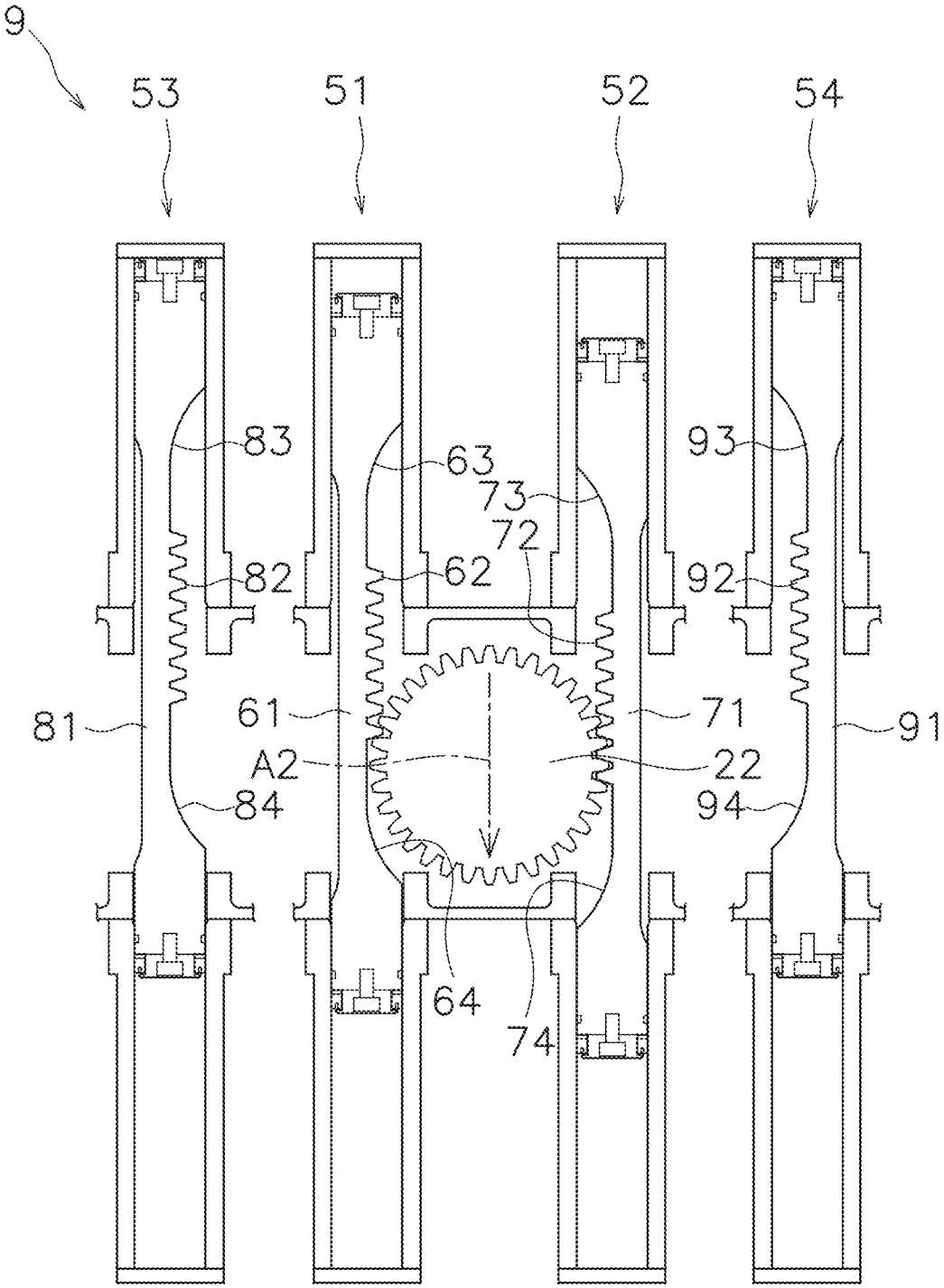
FIG. 8 is a top view showing the operation of the steering mechanism according to a modification of a preferred embodiment of the present invention.

FIG. 8 shows the steering mechanism 9 in a neutral state. In a case where the steering mechanism 9 is in the neutral state, the pinion gear 22 meshes with at least one of the first teeth 62 and the second teeth 72, and faces the sixth relief portion 84 and the eighth relief portion 94.

Figure 9:
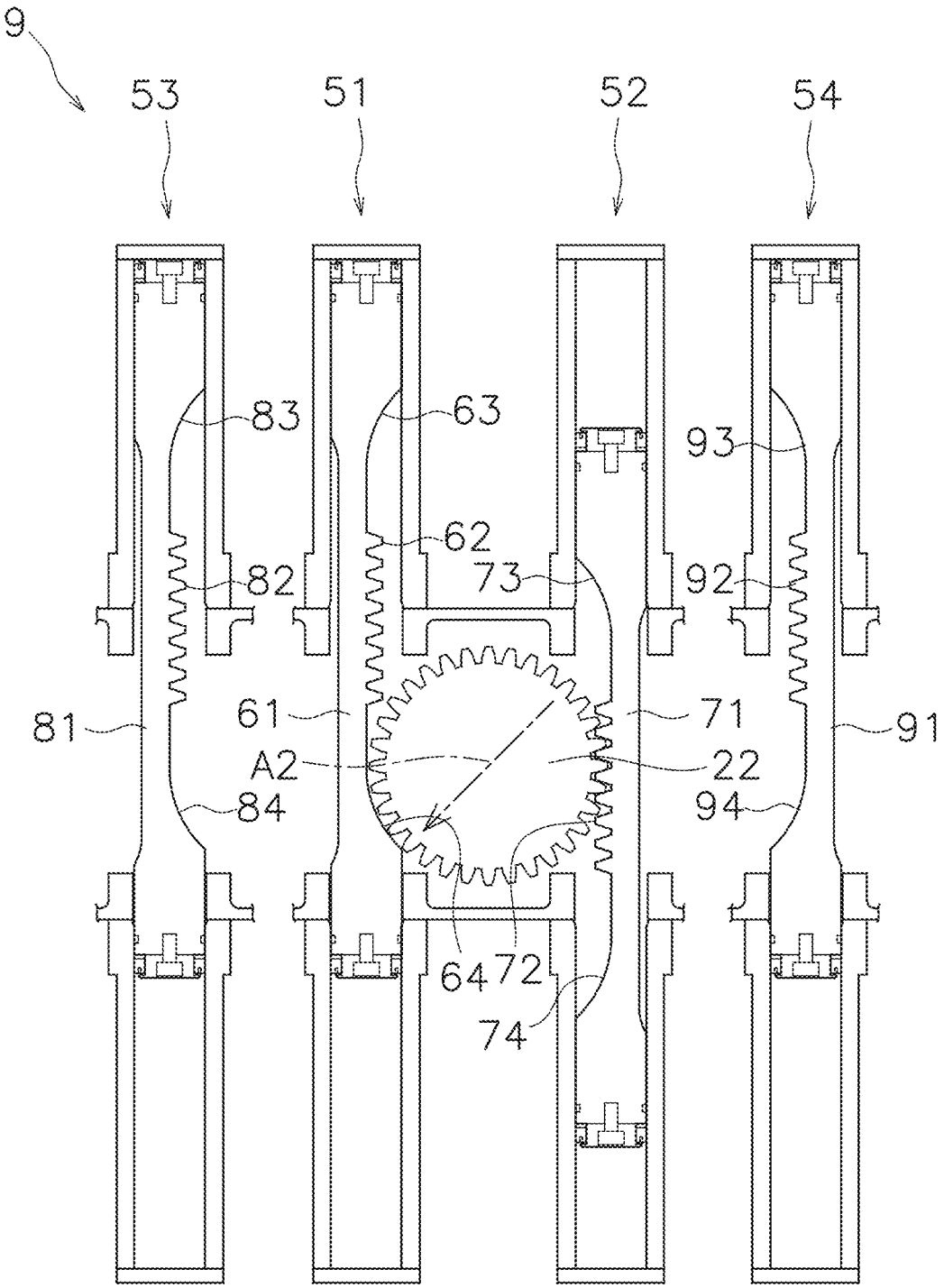
FIG. 9 is a top view showing the operation of the steering mechanism according to a modification of a preferred embodiment of the present invention.

FIG. 9 shows the steering mechanism 9 in a first left steering state. As the second rack 71 moves rearward from the neutral state shown in FIG. 8, the steering mechanism 9 enters the first left steering state shown in FIG. 9. In a case where the steering mechanism 9 is in the first left steering state, the second teeth 72 meshes with the pinion gear 22, and the pinion gear 22 faces the third relief portion 64, the sixth relief portion 84, and the eighth relief portion 94. In the first left steering state, the second rack 71 moves rearward while the second teeth 72 meshes with the pinion gear 22, and the pinion gear 22 faces the third relief portion 64, the sixth relief portion 84, and the eighth relief portion 94 and idles with respect to the first rack 61, the third rack 81, and the fourth rack 91. Therefore, the first rack 61, the third rack 81, and the fourth rack 91 do not move, and the pinion gear 22 rotates according to the movement of the second rack 71. Thus, the second housing 4 is steered leftward.

Figure 10:
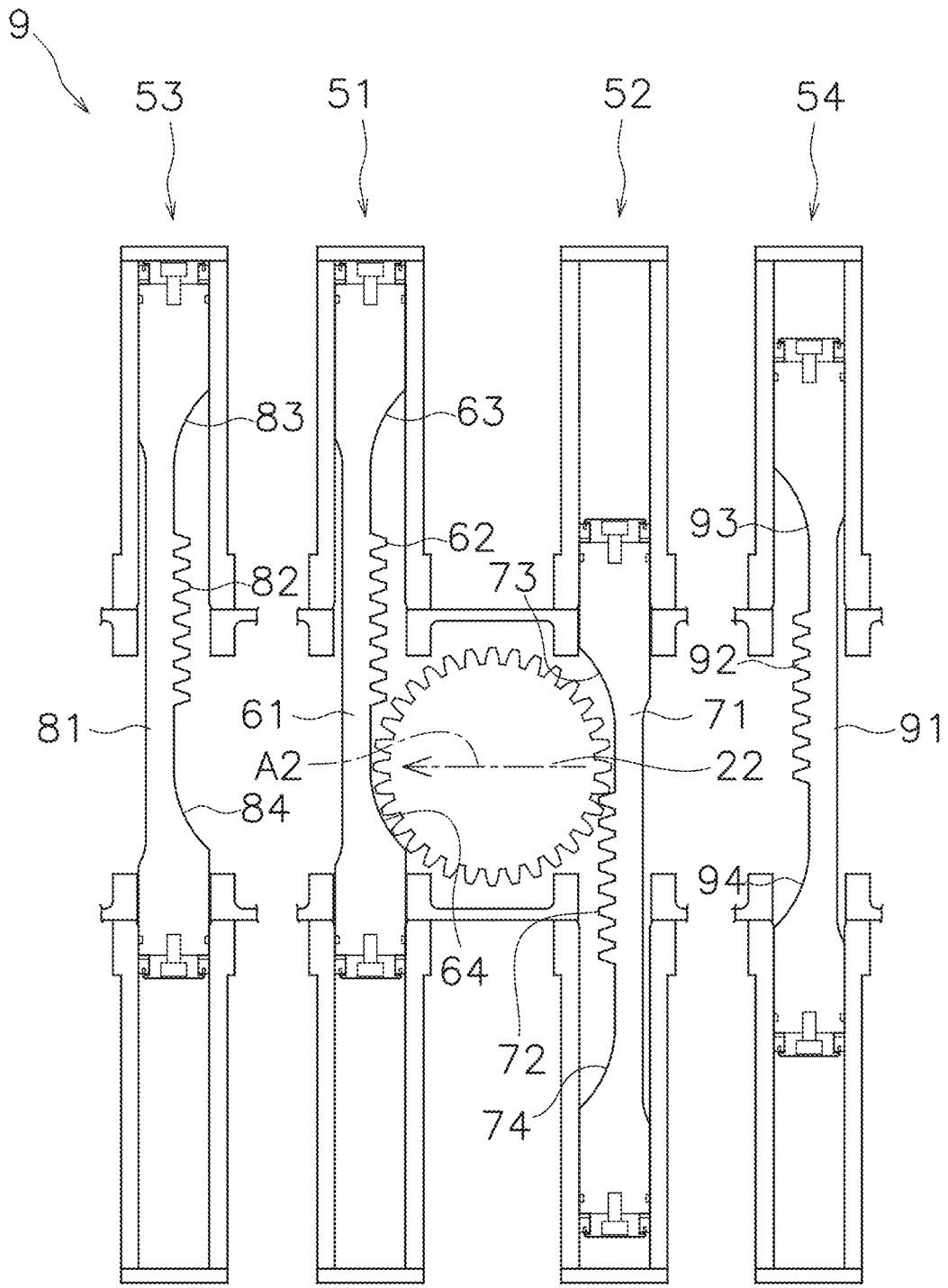
FIG. 10 is a top view showing the operation of the steering mechanism according to a modification of a preferred embodiment of the present invention.
Figure 11:
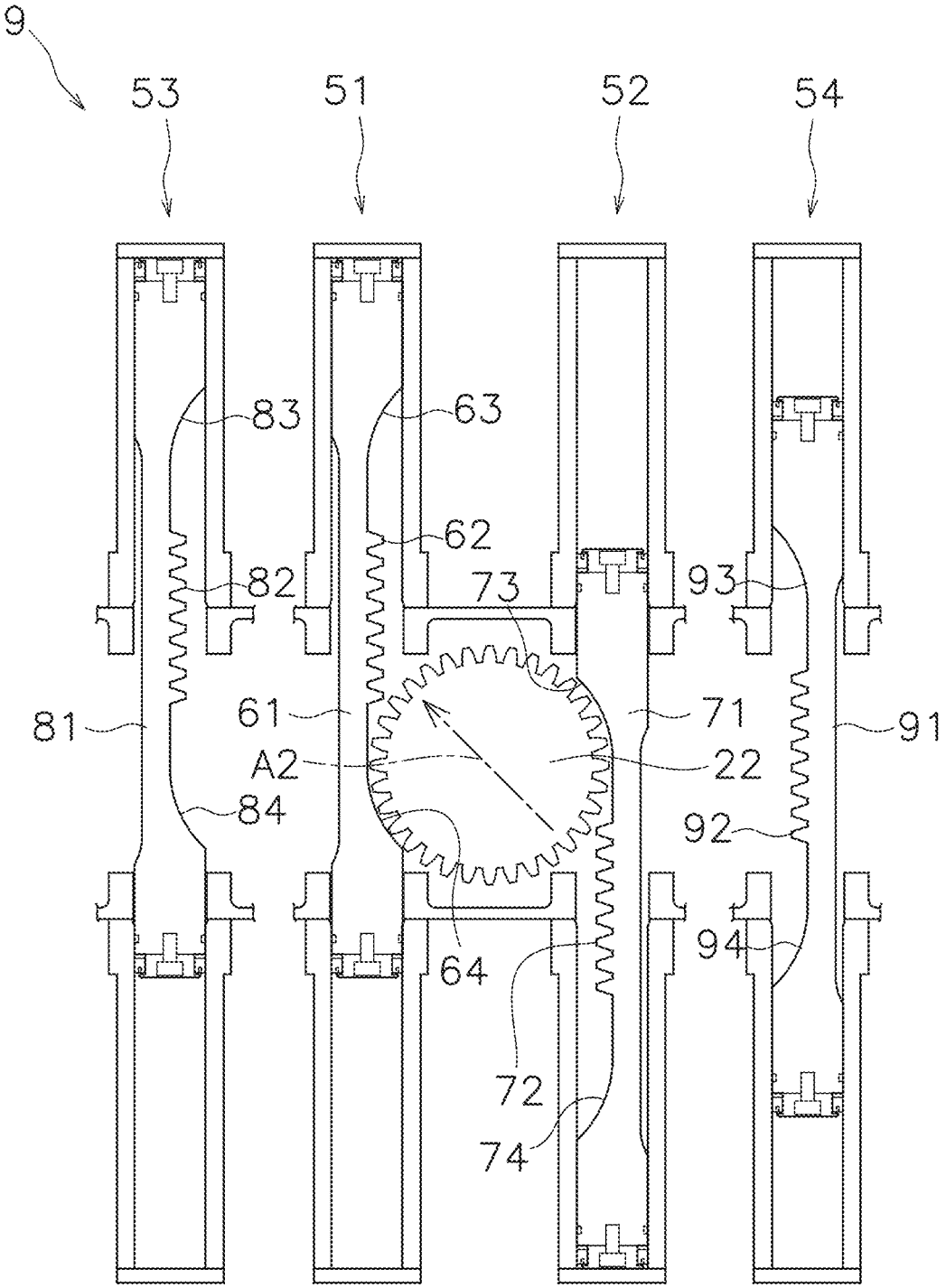
FIG. 11 is a top view showing the operation of the steering mechanism according to a modification of a preferred embodiment of the present invention.
Figure 12:
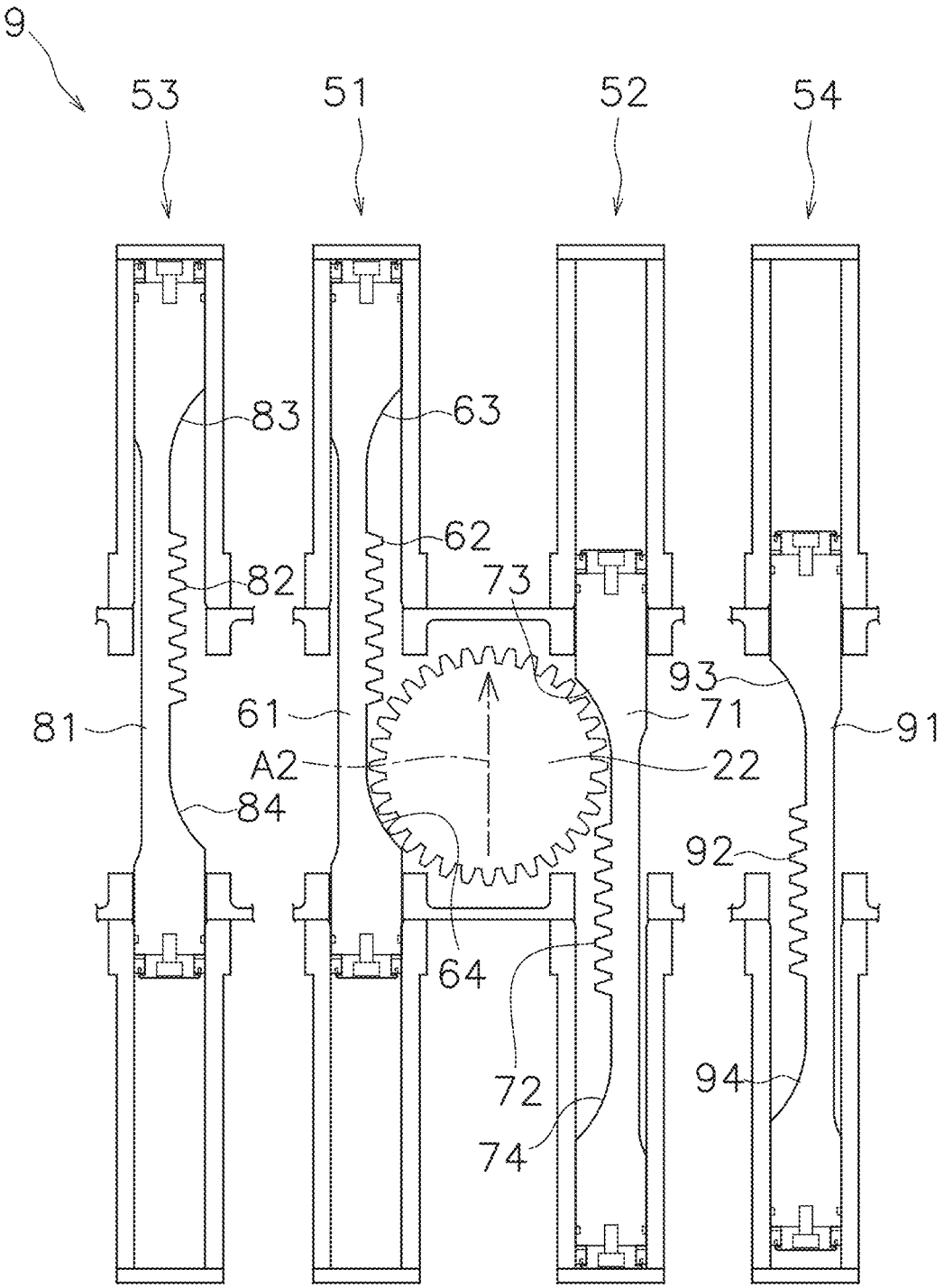
FIG. 12 is a top view showing the operation of the steering mechanism according to a modification of a preferred embodiment of the present invention.

FIGS. 10 to 12 show the steering mechanism 9 in a second left steering state. As shown in FIG. 10, as the fourth rack 91 moves rearward to mesh the fourth teeth 92 with the pinion gear 22 while the second relief portion 73 faces the pinion gear 22, the steering mechanism 9 enters the second left steering state.

As shown in FIGS. 10 and 11, in the second left steering state, the fourth rack 91 moves rearward while the fourth teeth 92 meshes with the pinion gear 22, and the pinion gear 22 faces the third relief portion 64, the second relief portion 73, and the sixth relief portion 84, and idles with respect to the first rack 61, the second rack 71, and the third rack 81. Therefore, the first rack 61, the second rack 71, and the third rack 81 do not move, and the pinion gear 22 rotates according to the movement of the fourth rack 91. Thus, the second housing 4 is steered leftward.

As shown in FIG. 12, in the second left steering state, the fourth rack 91 moves rearward until the seventh relief portion 93 faces the pinion gear 22. However, the seventh relief portion 93 may be omitted.

Figure 13:
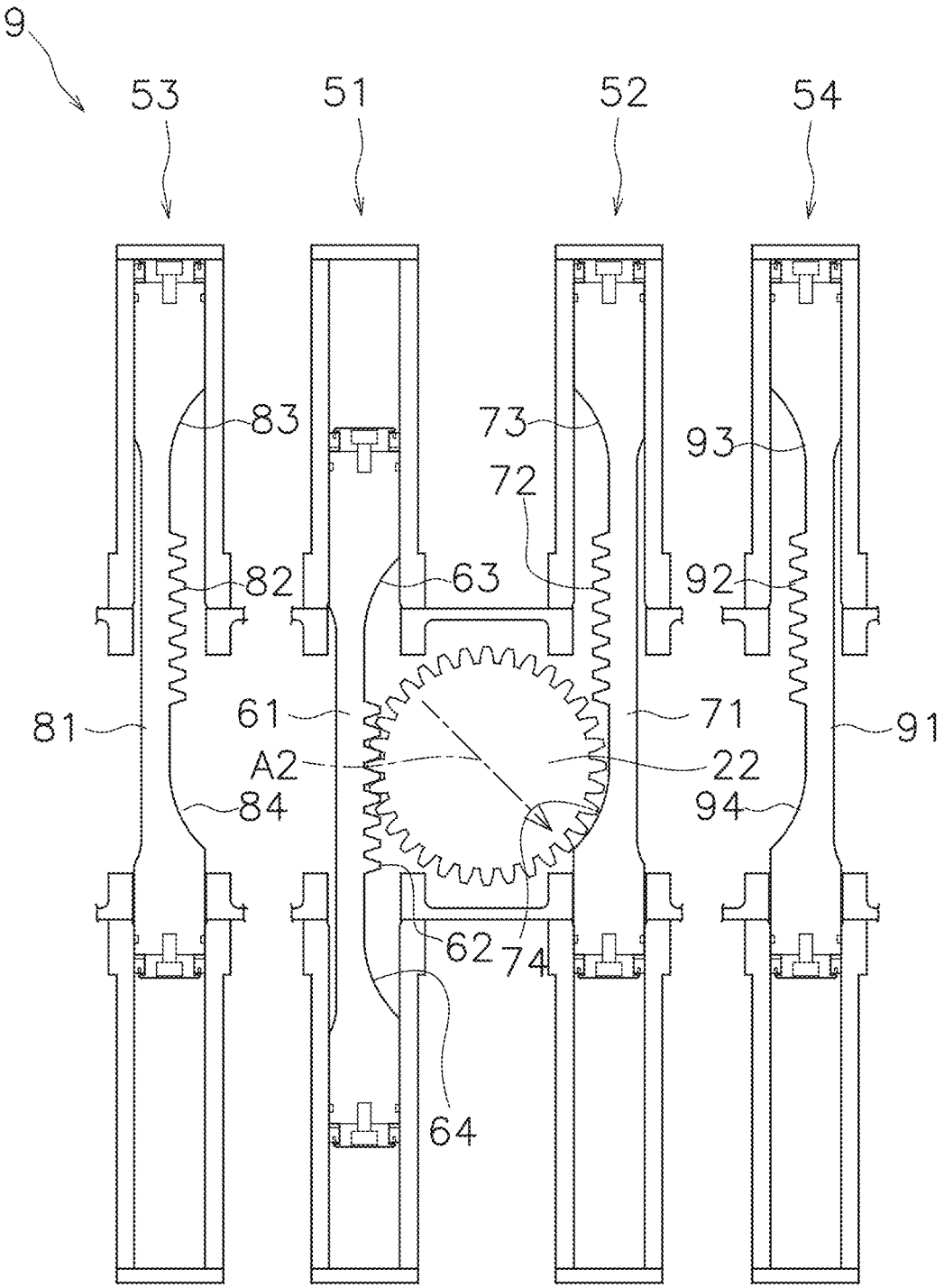
FIG. 13 is a top view showing the operation of the steering mechanism according to a modification of a preferred embodiment of the present invention.

FIG. 13 shows the steering mechanism 9 in a first right steering state. As the first rack 31 moves rearward from the neutral state shown in FIG. 8, the steering mechanism 9 enters the first right steering state shown in FIG. 13. In a case where the steering mechanism 9 is in the first right steering state, the first teeth 62 meshes with the pinion gear 22, and the pinion gear 22 faces the fourth relief portion 74, the sixth relief portion 84, and the eighth relief portion 94. In the first right steering state, the first rack 61 moves rearward while the first teeth 62 mesh with the pinion gear 22, and the pinion gear 22 faces the fourth relief portion 74, the sixth relief portion 84, and the eighth relief portion 94, and idles with respect to the second rack 71, the third rack 81, and the fourth rack 91. Therefore, the pinion gear 22 rotates according to the movement of the first rack 61 without driving the second rack 71, the third rack 81, and the fourth rack 91. Thus, the second housing 4 is steered to the right.

Figure 14:
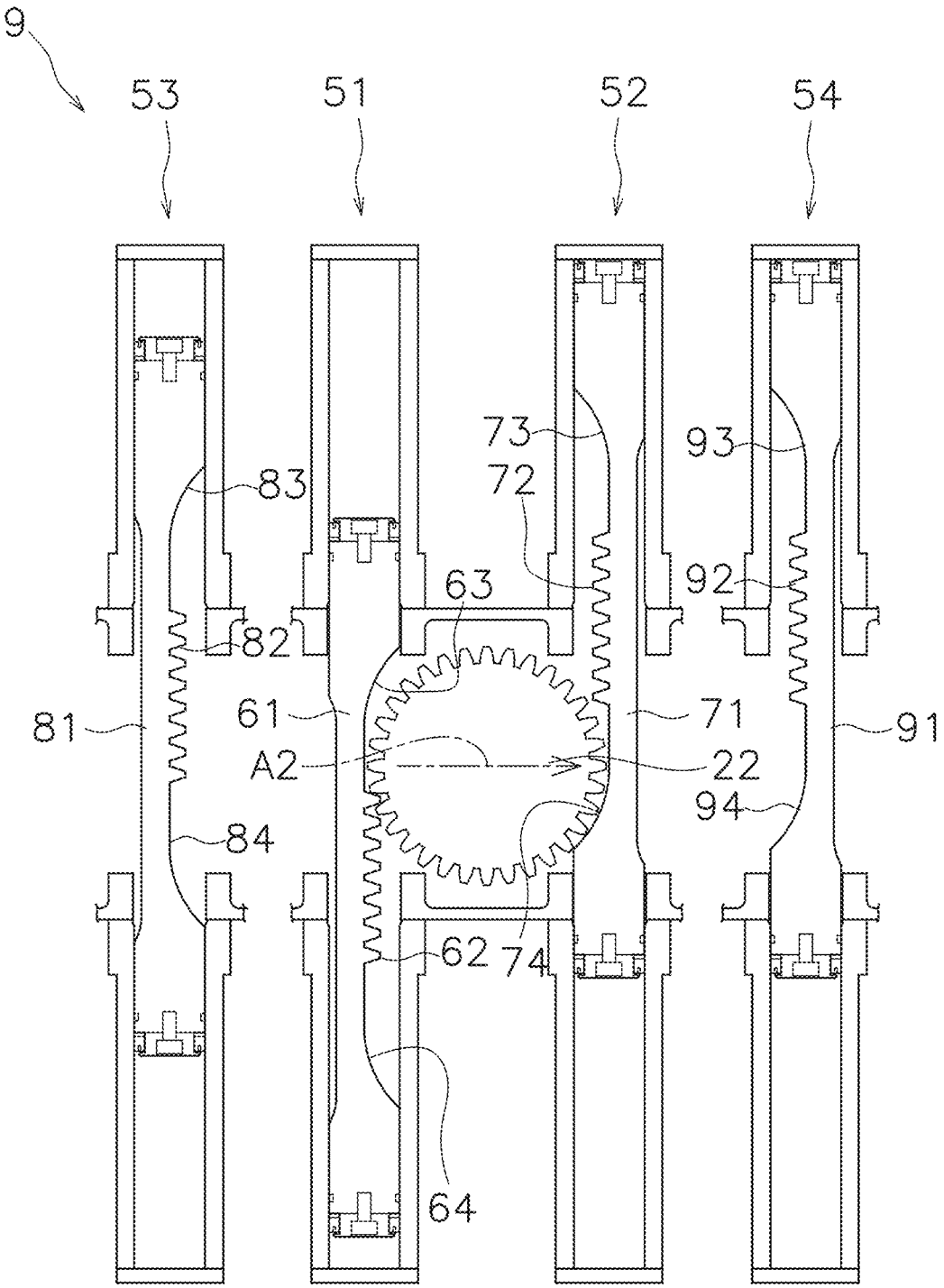
FIG. 14 is a top view showing the operation of the steering mechanism according to a modification of a preferred embodiment of the present invention.
Figure 15:
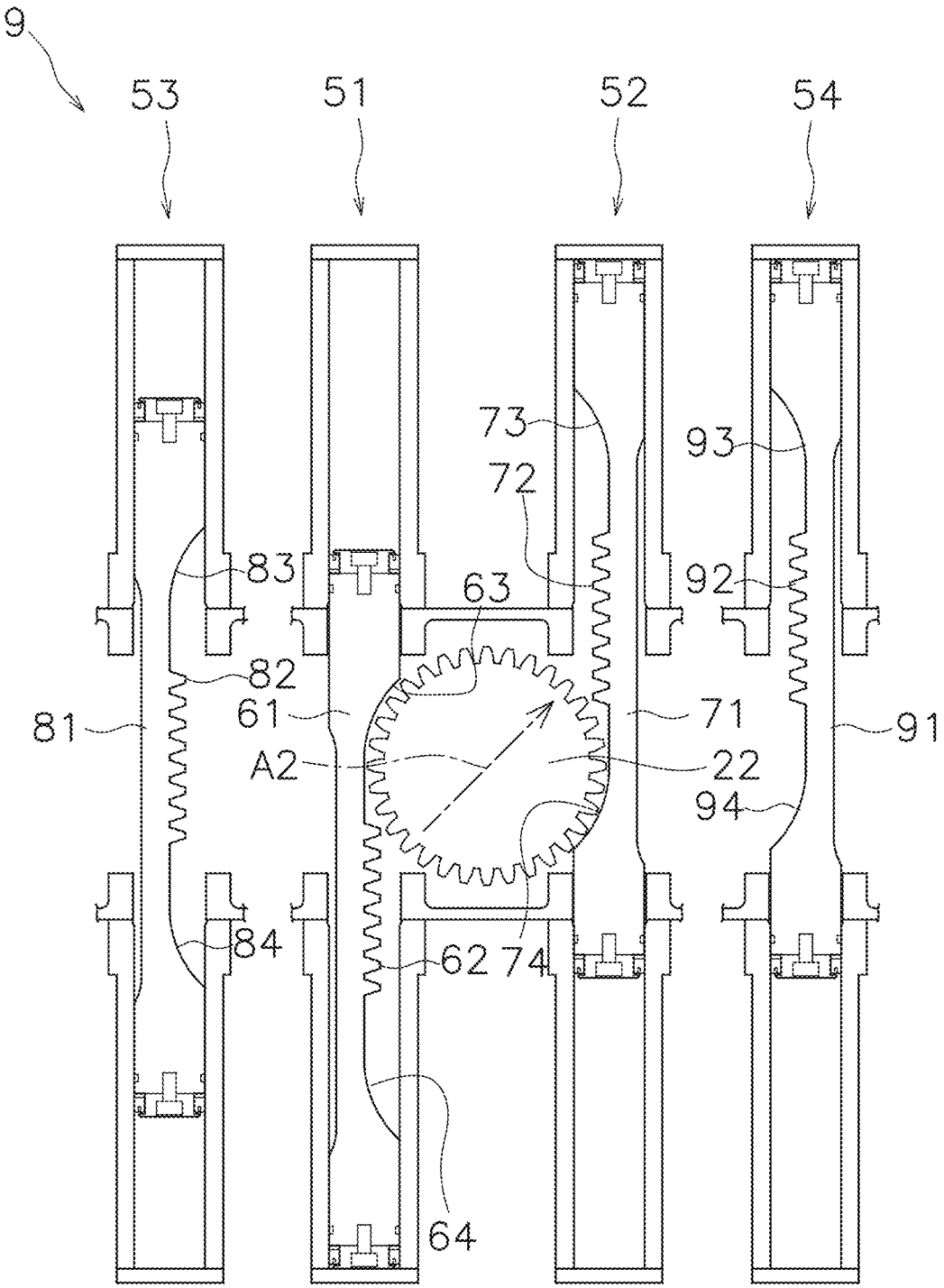
FIG. 15 is a top view showing the operation of the steering mechanism according to a modification of a preferred embodiment of the present invention.
Figure 16:
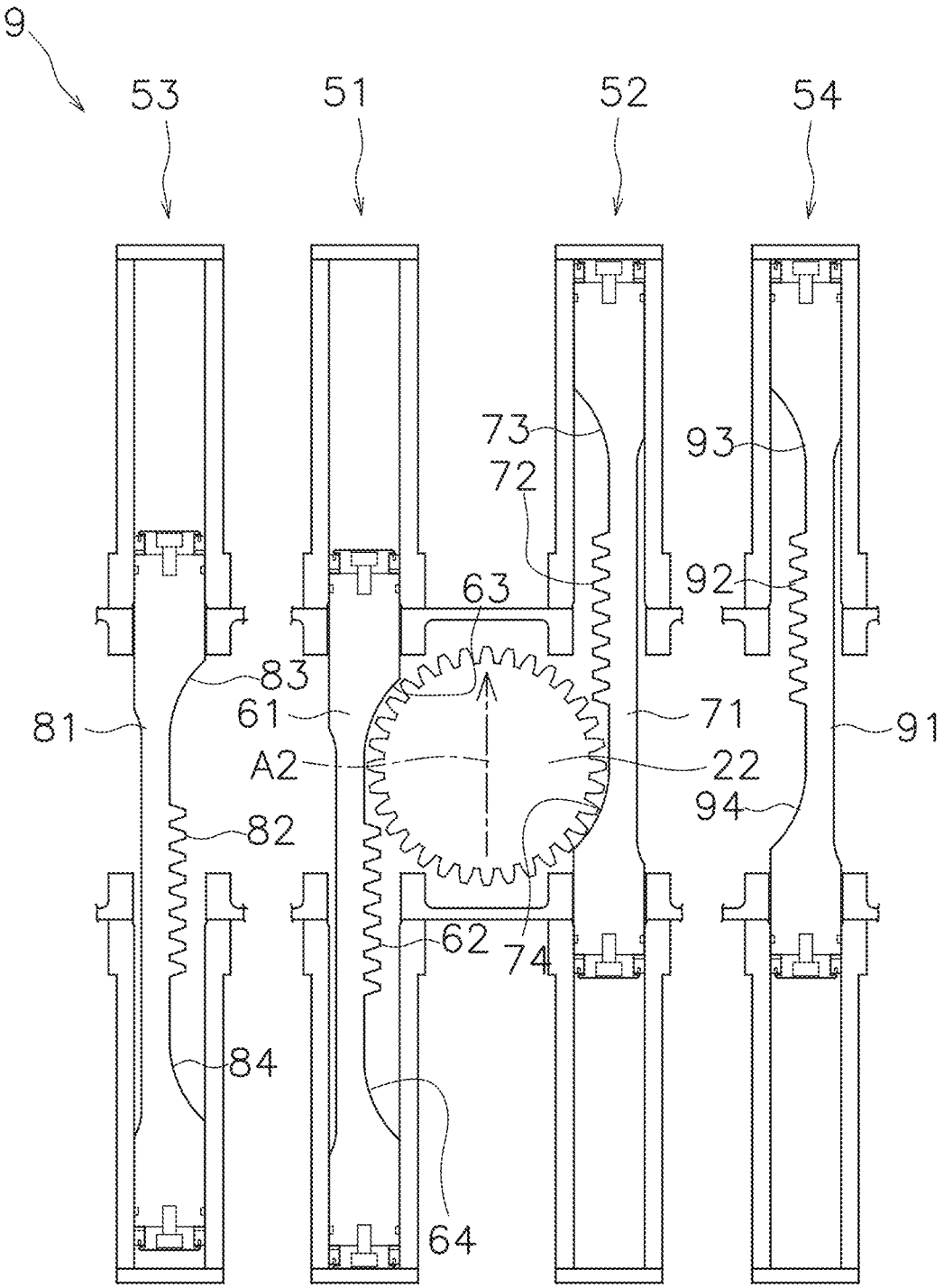
FIG. 16 is a top view showing the operation of the steering mechanism according to a modification of a preferred embodiment of the present invention.

FIGS. 14 to 16 show the steering mechanism 9 in a second right steering state. As shown in FIG. 14, as the third rack 81 moves rearward and the third teeth 82 mesh with the pinion gear 22 while the first relief portion 63 faces the pinion gear 22, the steering mechanism 9 enters the second right steering state.

As shown in FIGS. 14 and 15, in the second right steering state, the third rack 81 moves rearward while the third teeth 82 mesh with the pinion gear 22, and the pinion gear 22 faces the first relief portion 63, the fourth relief portion 74, and the eighth relief portion 94, and idles with respect to the first rack 61, the second rack 71, and the fourth rack 91. Therefore, the first rack 61, the second rack 71, and the fourth rack 91 do not move, and the pinion gear 22 rotates according to the movement of the third rack 81. Thus, the second housing 4 is steered to the right.

As shown in FIG. 16, in the second right steering state, the third rack 81 moves rearward until the fifth relief portion 83 faces the pinion gear 22. However, the fifth relief portion 83 may be omitted.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

a first housing;

a second housing supported by the first housing and steerable around a steering axis;

a propeller shaft in the second housing and extending in a front-rear direction of the outboard motor; and a steering mechanism to steer the second housing around the steering axis, the steering mechanism including:

a pinion gear connected to the first housing or the second housing;

a first rack including a plurality of first teeth that mesh with the pinion gear and arranged side by side with each other in a first direction, and a first relief portion that does not mesh with the pinion gear to allow the pinion gear to idle, the first rack being movable in the first direction; and a second rack including a plurality of second teeth that mesh with the pinion gear and are arranged side by side with each other in a second direction, the second rack being movable in the second direction.

2. The outboard motor according to claim 1, wherein the first relief portion faces the pinion gear in a state in which the plurality of first teeth do not mesh with the pinion gear.

3. The outboard motor according to claim 1, wherein the first relief portion faces the pinion gear in a state in which the plurality of second teeth mesh with the pinion gear.

4. The outboard motor according to claim 1, wherein, as the second rack moves in the second direction while the plurality of second teeth mesh with the pinion gear, the pinion gear faces the first relief portion and idles with respect to the first rack.

5. The outboard motor according to claim 1, wherein the second rack includes a second relief portion that does not mesh with the pinion gear and allows the pinion gear to idle.

6. The outboard motor according to claim 5, wherein the second relief portion faces the pinion gear in a state in which the plurality of second teeth do not mesh with the pinion gear.

7. The outboard motor according to claim 5, wherein the second relief portion faces the pinion gear in a state in which the plurality of first teeth mesh with the pinion gear.

8. The outboard motor according to claim 5, wherein, as the first rack moves in the first direction while the plurality of first teeth mesh with the pinion gear, the pinion gear faces the second relief portion and idles with respect to the second rack.

9. The outboard motor according to claim 1, further comprising a first hydraulic actuator to move the first rack in the first direction.

10. The outboard motor according to claim 1, further comprising a second hydraulic actuator to move the second rack in the second direction.

11. The outboard motor according to claim 1, wherein the first direction is a front-rear direction of the outboard motor.

12. The outboard motor according to claim 1, wherein the second direction is a front-rear direction of the outboard motor.

* * * * *